US009139011B2

(12) United States Patent
Ishizawa et al.

(10) Patent No.: US 9,139,011 B2
(45) **Date of Patent: *Sep. 22, 2015**

(54) TANK UNIT AND LIQUID EJECTING SYSTEM HAVING TANK UNIT

(71) Applicant: Seiko Epson Corporation, Shinjuku-ku (JP)

(72) Inventors: Taku Ishizawa, Shiojiri (JP); Yoshiaki Shimizu, Matsumoto (JP); Masaru Takahashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/274,401

(22) Filed: May 9, 2014

(65) Prior Publication Data

US 2014/0247310 A1 Sep. 4, 2014

Related U.S. Application Data

(62) Division of application No. 13/224,277, filed on Sep. 1, 2011, now Pat. No. 8,757,781.

(30) Foreign Application Priority Data

Sep. 3, 2010 (JP) ..... 2010-197269

(51) Int. Cl.
*B41J 2/17* (2006.01)
*B41J 2/175* (2006.01)

(52) U.S. Cl.
CPC ..... *B41J 2/175* (2013.01); *B41J 2/17513* (2013.01); *B41J 2/17553* (2013.01); *Y10T 29/49401* (2015.01)

(58) Field of Classification Search
USPC ..... 347/84–86
See application file for complete search history.

(56) References Cited

U.S. PATENT DOCUMENTS

| | | | | |
|---|---|---|---|---|
| 5,148,194 | A * | 9/1992 | Asai et al. | 347/49 |
| 6,033,064 | A * | 3/2000 | Pawlowski et al. | 347/87 |
| 7,040,744 | B2 * | 5/2006 | Shinada | 347/86 |
| 7,175,264 | B2 | 2/2007 | Qingguo et al. | |
| 7,967,427 | B2 | 6/2011 | Ishizawa et al. | |
| 8,757,781 | B2 * | 6/2014 | Ishizawa et al. | 347/84 |
| 2005/0110843 | A1 | 5/2005 | Capano | |
| 2005/0110849 | A1 | 5/2005 | Mui et al. | |

(Continued)

FOREIGN PATENT DOCUMENTS

| | | | |
|---|---|---|---|
| CN | 102336063 | A | 2/2012 |
| EP | 0968090 | B1 | 7/2003 |
| EP | 1 844 938 | A2 | 10/2007 |
| EP | 1 844 938 | A3 | 8/2009 |
| JP | 2005-219483 | A | 8/2005 |

*Primary Examiner* — Henok Legesse

(74) *Attorney, Agent, or Firm* — Kilpatrick Townsend & Stockton LLP

(57) ABSTRACT

A tank unit includes two or more liquid accommodating containers disposed in a row. Each of the liquid accommodating containers includes a main body having a concave shape defining a side opening and a film that blocks the side opening. The main body and the film at least partially define a liquid accommodating chamber for accommodating a liquid. The main body includes a facing wall that faces the film across the liquid accommodating chamber and has a wall larger than the side opening. The liquid accommodating containers are disposed such that the film of at least one of the liquid accommodating containers is covered by the facing wall of an adjacent one of the liquid accommodating containers.

11 Claims, 6 Drawing Sheets

(56) References Cited

U.S. PATENT DOCUMENTS

| | | | | |
|---|---|---|---|---|
| 2005/0116997 | A1 | 6/2005 | Katoh et al. | |
| 2007/0070141 | A1 | 3/2007 | Hattori et al. | |
| 2008/0284832 | A1 * | 11/2008 | Chung et al. | 347/86 |
| 2009/0237474 | A1 | 9/2009 | Ishizawa et al. | |
| 2009/0262170 | A1 | 10/2009 | Ishizawa | |
| 2010/0013896 | A1 * | 1/2010 | Ishizawa et al. | 347/86 |
| 2012/0013687 | A1 | 1/2012 | Ishizawa et al. | |
| 2012/0038719 | A1 * | 2/2012 | Shimizu et al. | 347/86 |

* cited by examiner

TANK UNIT AND LIQUID EJECTING SYSTEM HAVING TANK UNIT

This application is a divisional of U.S. patent application Ser. No. 13/224,277, filed Sep. 1, 2011, which claims priority to Japanese Patent Application No. 2010-197269, filed on Sep. 3, 2010, the entire disclosures of which are incorporated by reference herein.

BACKGROUND

1. Technical Field

The present invention relates to a tank unit that includes two or more liquid accommodating containers and a liquid ejecting system that includes the tank unit.

2. Related Art

A printer, which is one example of a liquid ejecting apparatus, performs printing by discharging ink from a recording head onto a recording target (for example, printing paper). A known technique of supplying ink to a recording head includes supplying ink from a tank unit disposed external to the recording head through a tube (for example, JP-A-2005-219483). The tank unit can include two or more ink tanks (liquid accommodating containers), which accommodate ink.

An ink tank of the tank unit needs to have an internal space to accommodate ink. Here, there is a case where an ink tank having a space in the inside is manufactured using two hard members molded by using synthetic resin such as polypropylene (hereinafter also referred to as "PP"). Specifically, there is a case where an ink tank having an internal space for accommodating ink is manufactured by joining an opening member with one side face opened and a cover member which blocks an opening, by vibration welding.

However, in the case of manufacturing a tank unit by combining a plurality of ink tanks manufactured by using vibration welding, there is a case where various problems arise. For example, there is a case where shaving dregs (impurities) which are generated due to vibration welding remain in the inside of an ink tank, so that the shaving dregs are mixed with ink. In this case, ink with the shaving dregs mixed therein is supplied from a tank unit to a printer, causing generation of problems for the printer. Further, in the case of manufacturing an ink tank by using vibration welding, a device for vibration welding needs to be used, so that there is a case where the production costs of the ink tank increase or the production process of the ink tank is complicated. Such problems are not limited to the tank unit which includes the ink tanks and are problems common to a tank unit which is provided with liquid accommodating containers and is for supplying liquid from the outside of a liquid ejecting apparatus to the liquid ejecting apparatus.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

A tank unit is disclosed that includes two or more liquid accommodating containers, as well as a liquid ejecting system that includes the tank unit. In many embodiments, the tank unit includes a plurality of liquid accommodating chambers disposed in a row, each of which is formed by the attachment of a film to a surface of a tank main body. As compared to where a liquid accommodating chamber is formed by vibration welding a hard cover member to the tank main body, attaching a film to the tank main body avoids the generation of debris often generated during vibration welding, thereby preventing such debris from contaminating liquid in the tank unit. Additionally, the tank unit is configured such that the liquid accommodating chambers are aggregated so that the films are protected from damage. And the number of ink tanks can be easily changed to accommodate any suitable number of liquid accommodating chambers for a given liquid ejecting system.

Thus, in one aspect, a tank unit is disclosed for supplying liquid from outside of a liquid ejecting apparatus to the liquid ejecting apparatus. The tank unit includes a plurality of liquid accommodating containers disposed in a row. Each of the liquid accommodating chambers includes a main body having a concave shape defining a side opening and a film that blocks the side opening. The main body and the film at least partially define a liquid accommodating chamber for accommodating a liquid. The main body includes a facing wall that faces the film across the liquid accommodating chamber. The facing wall has a wall larger than the side opening. The liquid accommodating containers are disposed such that the film of at least one of the liquid accommodating chambers is covered by the facing wall of an adjacent one of the liquid accommodating containers. Accordingly, the liquid accommodating container can be easily manufactured by attaching the film to the container main body. Further, since the liquid accommodating container is manufactured by attaching the film to the container main body, a possibility that impurities may be mixed in the inside of the liquid accommodating container can be reduced. Furthermore, since the film is covered by the facing wall of an adjacent container main body, a possibility that liquid may be leaked from the inside due to breakage of the film can be reduced.

In many embodiments, at least one of the facing walls defines a concave-shaped receptacle open to a side of the main body opposite to the liquid accommodating chamber. And two or more of the liquid accommodating chambers are disposed such that the film covered side opening of at least one of the liquid accommodating chambers is disposed within the concave-shaped receptacle of the adjacent one of the liquid accommodating chambers. Accordingly, since the film covered side opening is disposed within the concave-shaped receptacle of the adjacent one of the liquid accommodating chambers, a possibility that the film may be broken can be further reduced. Further, the liquid accommodating containers adjacent to each other can be easily fitted to and integrated with each other by making one side face of one liquid accommodating container enter the concave portion of the facing wall of the other adjacent liquid accommodating container.

In many embodiments, each of the liquid accommodating chambers further includes at least one fitting unit. Each of the fitting units is configured for removable coupling to one of the fitting units of an adjacent one of the liquid accommodating containers. Each of the fitting units can include a projection portion and a hole portion into which the projection portion of a fitting unit of an adjacent one of the liquid accommodating containers is fitted. Accordingly, two or more of the liquid accommodating containers can be easily assembled and integrated and a possibility that the integrated liquid accommodating containers may come apart can also be reduced.

In many embodiments, the tank unit further includes a cover member. The cover member covers the film of one of the liquid accommodating containers disposed at an end of the row. Accordingly, a possibility that the film of the exposed liquid accommodating container may be broken can be reduced.

In many embodiments, each of the liquid accommodating chambers includes a liquid injection port through which liquid can be injected into the liquid accommodating chamber and a detachably mounted plug member configured to block the liquid injection port. At least one of the plug members is connected to a plug member of an adjacent one of the liquid accommodating containers by a connection member. Accordingly, even in a case where the plug member (also referred to as a "target plug member") is detached from the liquid injection port when injecting liquid into one liquid accommodating container, the target plug member remains connected to the plug member (also referred to as an "adjacent plug member") of the other adjacent liquid accommodating container. Here, since the adjacent plug member remains mounted on the liquid injection port, even if the target plug member is detached, the target plug member is located in the vicinity of the adjacent plug member. Accordingly, a possibility that a user may lose the detached plug member can be reduced.

In another aspect, a liquid ejecting system is provided. The liquid ejecting system can include any tank unit as set forth herein, a liquid ejecting apparatus that includes a head configured to eject liquid onto a target, and a flow tube that connects the tank unit and the liquid ejecting apparatus. The flow tube is configured to transfer liquid from the tank unit to the liquid ejecting apparatus. Accordingly, a liquid ejecting system can be provided that receives a supply of liquid from the tank unit and then ejects the liquid onto a target, in which a possibility that impurities may be mixed with liquid in the tank unit is reduced.

In many embodiments, the liquid ejecting apparatus includes a printer and the tank unit accommodates one or more inks. Accordingly, a liquid ejecting system can be provided that receives a supply of ink from the tank unit and then ejects the ink onto a target, in which a possibility that impurities may be mixed with ink accommodated in the tank unit is reduced.

In addition, the invention can be realized in various aspects and can be realized in aspects such as a manufacturing method of the above-described tank unit and a liquid ejecting method using the above-described liquid ejecting system, besides the above-described tank unit and the above-described liquid ejecting system, which includes a liquid ejecting apparatus and a tank unit.

For example, in another aspect, a method of making a tank unit for supplying liquid to a liquid ejecting apparatus is provided. The method includes providing a first main body having a first concave shape defining a first side opening, the first concave shape being partially defined by a first facing wall portion of the first main body; attaching a first film to the first main body to block the first side opening so that the combination of the first main body and the first film at least partially defines a first liquid chamber for accommodating a first liquid, the first facing wall portion facing the first film across the first liquid chamber; providing a second main body having a second concave shape defining a second side opening, the second concave shape being partially defined by a second facing wall portion of the second main body; attaching a second film to the second main body to block the second side opening so that the combination of the second main body and the second film at least partially defines a second liquid chamber for accommodating a second liquid, the second facing wall portion facing the second film across the second liquid chamber; and coupling the second main body with the first main body so that the second facing wall portion covers the first film.

In many embodiments, the tank unit includes additional liquid chambers. For example, the above method can further include providing a third main body having a third concave shape defining a third side opening, the third concave shape being partially defined by a third facing wall portion of the third main body; attaching a third film to the third main body to block the third side opening so that the combination of the third main body and the third film at least partially defines a third liquid chamber for accommodating a third liquid, the third facing wall portion facing the third film across the third liquid chamber; and coupling the third main body with the second main body so that the third facing wall portion covers the second film. And the method can further include providing a fourth main body having a fourth concave shape defining a fourth side opening, the fourth concave shape being partially defined by a fourth facing wall portion of the fourth main body; attaching a fourth film to the fourth main body to block the fourth side opening so that the combination of the fourth main body and the fourth film at least partially defines a fourth liquid chamber for accommodating a fourth liquid, the fourth facing wall portion facing the fourth film across the fourth liquid chamber; and coupling the fourth main body with the third main body so that the fourth facing wall portion covers the third film.

In many embodiments, a side cover is used to cover the film on an end liquid chamber in an aggregation of liquid chambers. For example, the method can further include providing a side cover, and coupling the side cover with the fourth main body so that the side cover covers the fourth film.

In many embodiments, the tank unit includes plug members that plug liquid injection ports of the liquid chambers, and adjacent plug members are joined by a connection member so that a plug member remains attached to the tank unit even when the plug member is removed from a corresponding liquid injection port. For example, the method can further include providing a first plug member configured to plug a first liquid injection port of the first main body; providing a second plug member configured to plug a second liquid injection port of the second main body, the second plug member being coupled with the first plug member by a first connection member; attaching the first plug member to the first main body to plug the first liquid injection port; attaching the second plug member to the second main body to plug the second liquid injection port; providing a third plug member configured to plug a third liquid injection port of the third main body; providing a fourth plug member configured to plug a fourth liquid injection port of the fourth main body, the fourth plug member being coupled with the third plug member by a second connection member; attaching the third plug member to the third main body to plug the third liquid injection port; and attaching the fourth plug member to the fourth main body to plug the fourth liquid injection port.

For a fuller understanding of the nature and advantages of the present invention, reference should be made to the ensuing detailed description and accompanying drawings.

BRIEF DESCRIPTION OF THE DRAWINGS

The invention will be described with reference to the accompanying drawings, wherein like numbers reference like elements.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Liquid Ejecting System

Figure 1A:
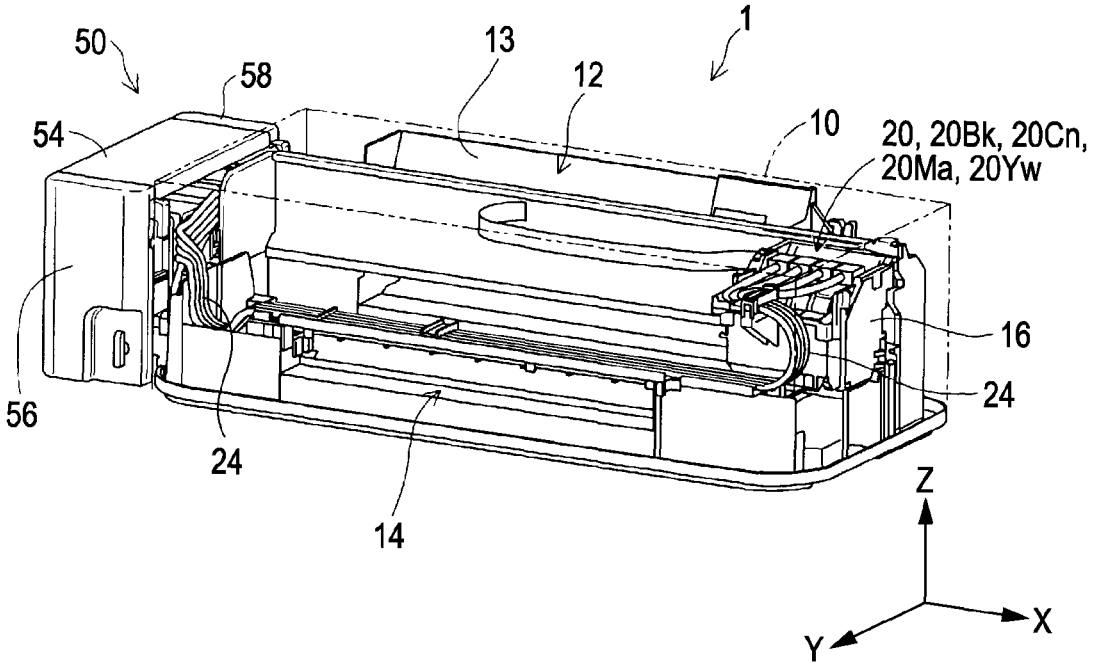
FIGS. 1A and 1B are perspective views illustrating a liquid ejecting system, in accordance with an embodiment.
Figure 1B:
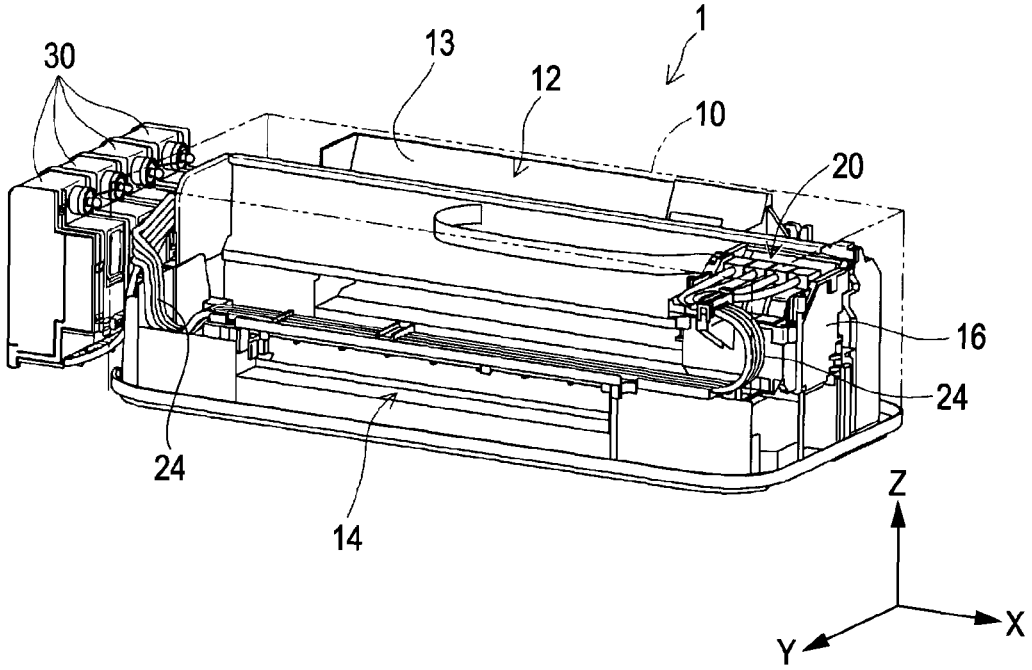

Referring now to the drawings, in which like reference numerals represent like parts throughout the several views, FIGS. 1A and 1B are diagrams for describing a liquid ejecting system 1 of an example. FIG. 1A is a first exterior perspective view of the liquid ejecting system 1. FIG. 1B is a second exterior perspective view of the liquid ejecting system 1 and is a diagram illustrating liquid accommodating containers 30 of the example of the invention. In addition, in FIGS. 1A and 1B, X, Y, and Z axes being normal to each other are shown in order to specify a direction. In addition, also with respect to the subsequent drawings, the X, Y, and Z axes being normal to each other are shown as necessary.

As shown in FIG. 1A, the liquid ejecting system 1 includes an ink jet printer 12 (also simply referred to as a "printer 12") as a liquid ejecting apparatus, and a tank unit 50. The printer 12 includes a paper feed section 13, a paper discharge section 14, a carriage 16 and four sub-tanks 20. The four sub-tanks 20 contain ink of different colors. Specifically, the four sub-tanks 20 are a sub-tank 20Bk that contains black ink, a sub-tank 20Cn that contains cyan ink, a sub-tank 20Ma that contains magenta ink, and a sub-tank 20Yw that contains yellow ink. The four sub-tanks 20 are mounted on the carriage 16.

Printing paper set in the paper feed section 13 is transported to the inside of the printer 12 and the printing paper after printing is discharged from the paper discharge section 14.

The carriage 16 is movable in a main scanning direction (a paper width direction or the X-axis direction). This movement is performed through a timing belt (not shown) by the driving of a stepping motor (not shown). A recording head (not shown) is provided and mounted on the lower surface of the carriage 16. Ink is ejected from a plurality of nozzles of the recording head onto the printing paper, whereby printing is performed. In addition, various components constituting the printer 12, such as the timing belt or the carriage 16, are housed inside a case 10, being protected thereby.

The tank unit 50 includes a top case 54, a first side case 56, a second side case 58, and a bottom case (not shown). The cases 54, 56, and 58 and the bottom case can be molded by using synthetic resin such as polypropylene (PP) or polystyrene (PS). In this example, the cases 54, 56, and 58 and the bottom case are molded using polystyrene. Further, as shown in FIG. 1B, the tank unit 50 has ink tanks 30 as four liquid accommodating containers in an internal space which is formed by the cases (cover members) 54, 56, and 58 and the bottom case (cover member). The tank unit 50 is more stably installed at a given place (for example, a desk or a shelf) by the cases 54, 56, and 58 and the bottom case. The four ink tanks 30 contain ink corresponding to colors that the four sub-tanks 20 contain. That is, the four ink tanks 30 respectively contain black ink, cyan ink, magenta ink, and yellow ink. In addition, the ink tank 30 can contain a larger amount of ink than the sub-tank 20.

The ink tank 30 with ink of each color contained therein is connected to the sub-tank 20 for containing ink of a corresponding color by a hose (tube) 24. The hose 24 is formed of a member having flexibility, such as synthetic rubber. If ink is ejected from the recording head, so that the ink in the sub-tank 20 is consumed, the ink in the ink tank 30 is supplied to the sub-tank 20 through the hose 24. In this way, the liquid ejecting system 1 can continue printing continuously without an interruption operation over a long period of time. In addition, it is also acceptable to directly supply ink from the ink tank 30 to the recording head through the hose 24 without providing the sub-tank 20.

Figure 2:
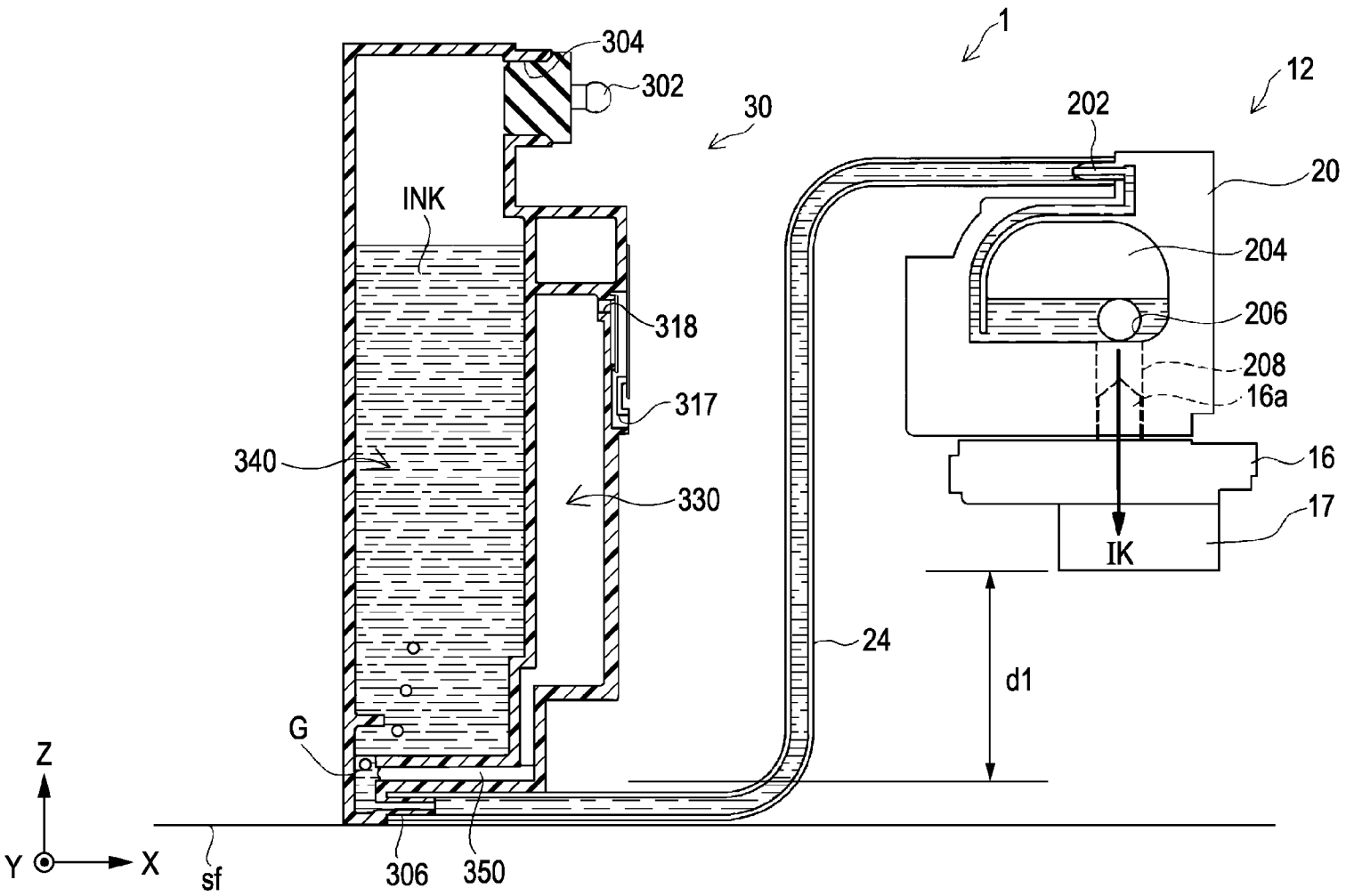
FIG. 2 is a diagram illustrating ink supply within the liquid ejecting system of FIGS. 1A and 1B.

Before explanation of the detailed configuration of the tank unit 50, in order to facilitate understanding, a principle in which ink is supplied from the ink tank 30 to the sub-tank 20 is described using FIG. 2. FIG. 2 is a diagram for describing ink supply from the ink tank 30 to the sub-tank 20. FIG. 2 schematically illustrates the configurations of the ink tank 30, the hose 24, and the printer 12.

The liquid ejecting system 1 is installed on a given horizontal surface sf. In a use position of the liquid ejecting system 1, the Z-axis negative direction becomes a vertically downward direction. The ink tank 30 has a liquid lead-out portion 306, a liquid accommodating chamber 340, an air accommodating chamber 330, a liquid injection port 304, a plug member 302, an air introduction port 317, and a port opened to the air 318.

The liquid accommodating chamber 340 accommodates ink. The liquid lead-out portion 306 of the ink tank 30 and a liquid receiving portion 202 of the sub-tank 20 are connected to each other by the hose 24. In this way, the ink in the liquid accommodating chamber 340 flows from the liquid lead-out portion 306 to the sub-tank 20 through the hose 24. The liquid injection port 304 communicates with the liquid accommodating chamber 340. The plug member 302 is detachably mounted on the liquid injection port 304, thereby preventing ink from being leaked from the liquid injection port 304 to the outside.

The air introduction port 317 and the port opened to the air 318 are both end portions of a meandering flow path for introducing air from the outside into the ink tank 30. The port opened to the air 318 communicates with the air accommodating chamber 330. The air accommodating chamber 330 communicates with the liquid accommodating chamber 340 through a communication portion 350 that is a narrow flow path. The communication portion 350 is made to be a flow path in which a flow path cross-sectional area is small to the extent capable of forming a meniscus (liquid surface bridge). In the use state of the ink tank 30, a meniscus is formed in the communication portion 350.

The air accommodating chamber 330 has a volume of given capacity and retains ink in a case where air in the liquid accommodating chamber 340 expands due to a change in temperature, or the like, so that ink flows back through the communication portion 350. That is, the ink tank 30 is provided with the air accommodating chamber 330, whereby even in a case where ink flows back, a possibility that ink may be leaked from the air introduction port 317 to the outside can be reduced.

In addition, in an injection position when injecting ink into the ink tank 30, the ink tank 30 is installed on the given horizontal surface (sf) such that the X-axis negative direction becomes a vertically downward direction. That is, the injection position is a position in which the liquid injection port 304 faces vertically upward. In addition, in the case of injecting ink into one of the ink tanks 30 of the tank unit 50 in which two or more of the ink tanks 30 are disposed (stacked), since the tank unit 50 integrally changes position, all the ink tanks 30 are made to be in the injection position. After ink is injected from the liquid injection port 304 into the liquid accommodating chamber 340 in the injection position, in a case where the liquid injection port 304 is hermetically sealed by the plug member 302 and the use position is set, air in the liquid accommodating chamber 340 expands, so that the liquid accommodating chamber 340 is maintained at negative pressure. Further, the air accommodating chamber 330 communicates with the port opened to the air 318, thereby being maintained at the atmospheric pressure.

The sub-tank 20 is molded by using synthetic resin such as polystyrene or polyethylene. The sub-tank 20 has an ink retention chamber 204, an ink flowing path 208, and a filter 206. In the ink flowing path 208, an ink supply needle 16*a* of the carriage 16 remains inserted. In a case where impurities such as foreign matter are mixed with ink, the filter 206 captures the impurities, thereby preventing inflow of the impurities to a recording head 17. The ink in the ink retention chamber 204 flows through the ink flowing path 208 and the ink supply needle 16*a* by suction from the recording head 17, thereby being supplied to the recording head 17. The ink supplied to the recording head 17 is ejected toward the outside (the printing paper) through the nozzle.

In the use position, the communication portion 350 which forms a meniscus is disposed so as to be located at a position lower than the recording head 17. Accordingly, a head difference d1 is generated. In addition, the head difference d1 in a state where the meniscus is formed in the communication portion 350 in the use position is also called a "stationary time head difference d1".

The ink in the ink retention chamber 204 is suctioned by the recording head 17, whereby the ink retention chamber 204 becomes equal to or more than a given negative pressure. If the ink retention chamber 204 becomes equal to or more than the given negative pressure, the ink in the liquid accommodating chamber 340 is supplied to the ink retention chamber 204 through the hose 24. That is, ink corresponding to an amount flowed out to the recording head 17 is automatically replenished from the liquid accommodating chamber 340 to the ink retention chamber 204. In other words, suction power (negative pressure) from the printer 12 side becomes larger to some extent than the head difference d1 which is generated by a height difference in vertical direction between an ink liquid surface coming into contact with the air accommodating chamber 330 in the ink tank 30 and the recording head (specifically, the nozzle), whereby ink is supplied from the liquid accommodating chamber 340 to the ink retention chamber 204.

If the ink in the liquid accommodating chamber 340 is consumed, air G (also referred to as an "air bubble G") in the air accommodating chamber 330 is introduced into the liquid accommodating chamber 340 through the communication portion 350. Accordingly, the liquid surface in the liquid accommodating chamber 340 is lowered.

Ink Tank Unit

Figure 3:
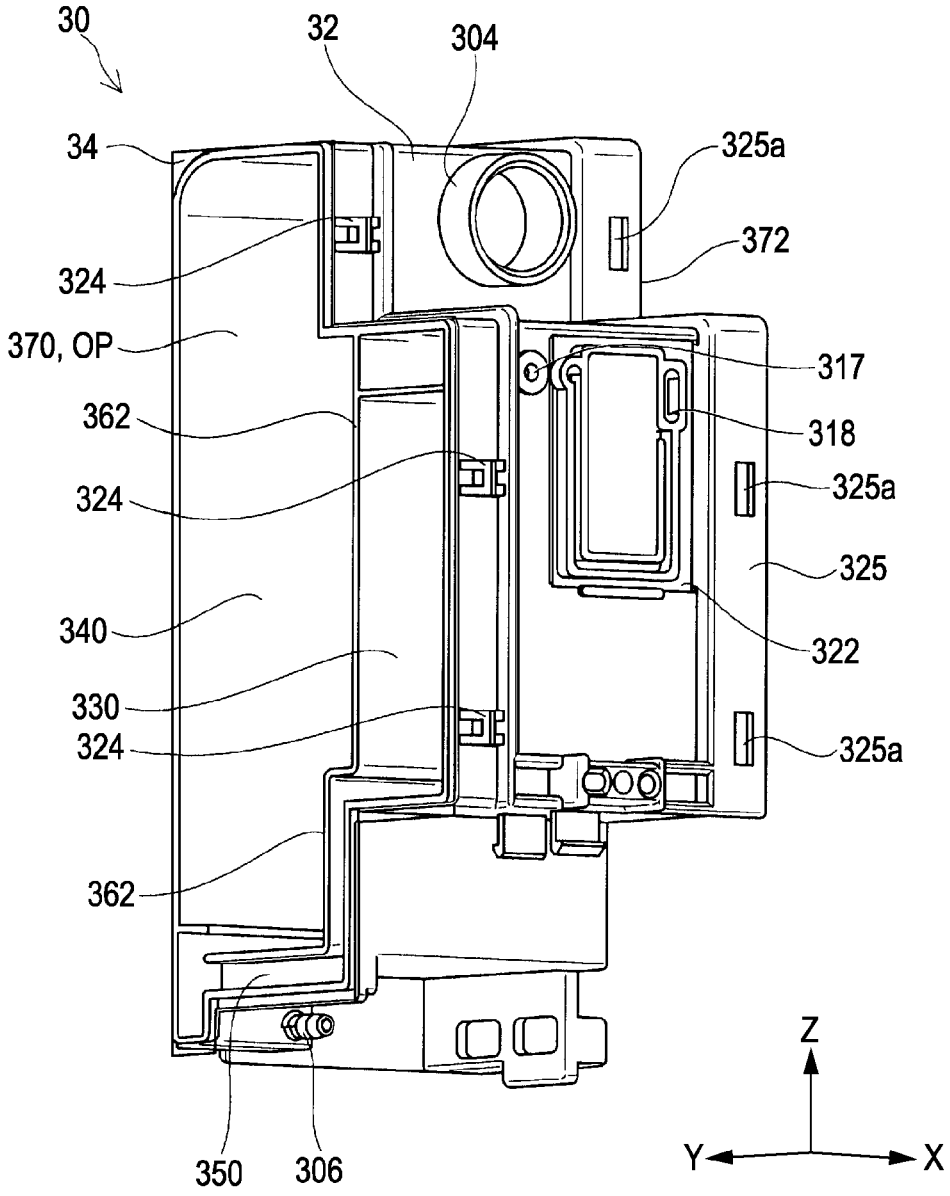
FIG. 3 is a first exterior perspective view of an ink tank of the liquid ejecting system of FIGS. 1A and 1B.
Figure 4:
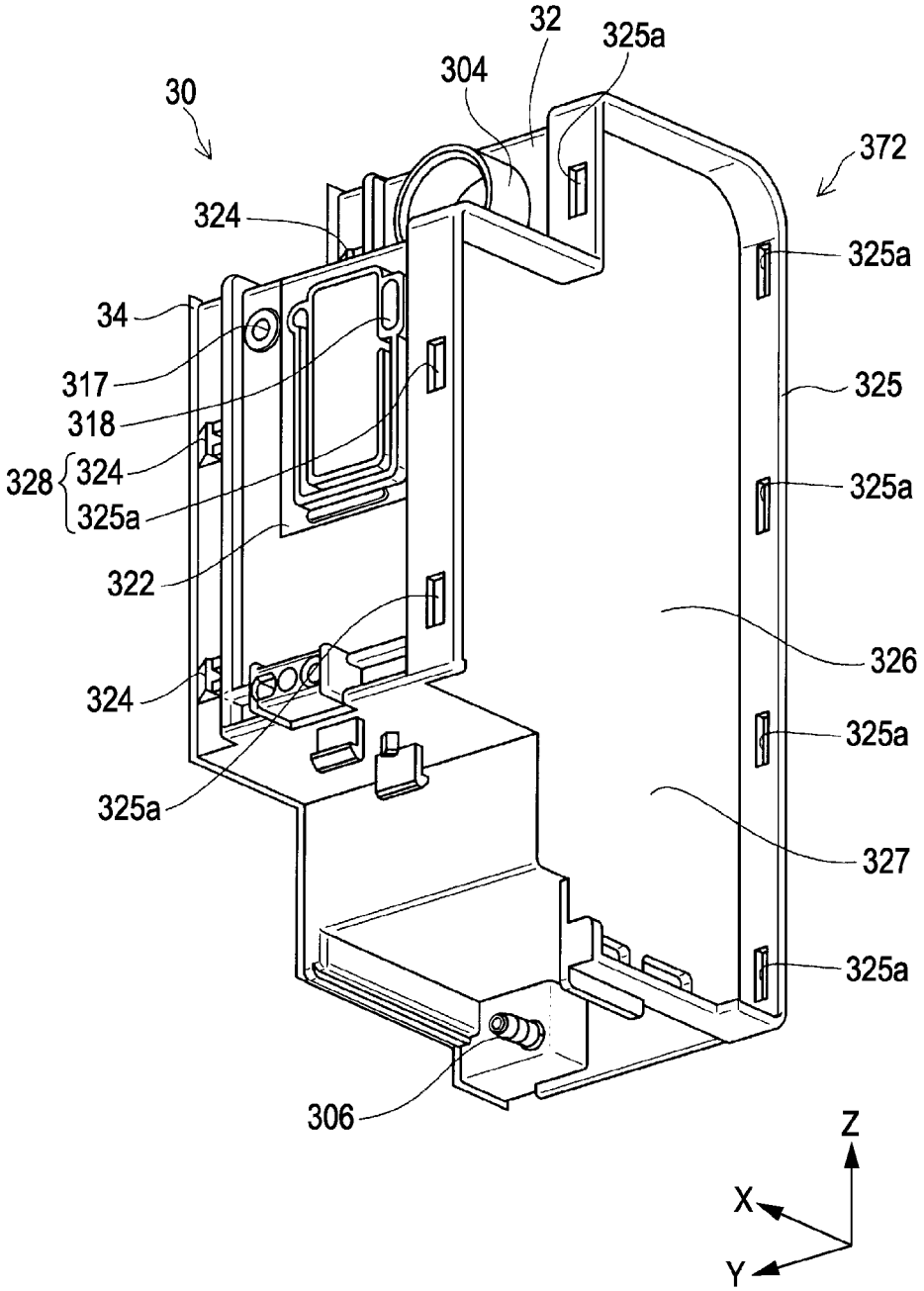
FIG. 4 is a second exterior perspective view of the ink tank of FIG. 3.

Next, the configuration of the ink tank 30 will be described using FIGS. 3 and 4. FIG. 3 is a first exterior perspective view of the ink tank 30. FIG. 4 is a second exterior perspective view of the ink tank 30. In addition, in FIGS. 3 and 4, illustration of the plug member 302 (FIG. 2) is omitted.

As shown in FIG. 3, the ink tank 30 includes a tank main body 32, a first film 34, and a second film 322. The tank main body 32 is molded by using synthetic resin such as polypropylene. Further, the tank main body 32 is translucent, so that the amount of ink in the inside can be confirmed from the outside. The shape of the tank main body 32 is a concave shape with one side face opened. Ribs 362 having various shapes are formed at a concave portion of the tank main body 32. Here, one side face which is opened (one side face including an outer frame of the tank main body 32 which forms an opening) is also referred to as an opening side face 370. Further, as shown in FIGS. 3 and 4, the tank main body 32 has a facing wall 372 which is a side surface that is at a position facing the opening side face 370 across an internal space (for example, the liquid accommodating chamber 340).

As shown in FIG. 3, the first film 34 is formed of synthetic resin such as polypropylene and is transparent. The first film 34 is attached to the tank main body 32 by thermal welding so as to cover an opening OP. Specifically, the first film 34 is tightly adhered to the end surfaces of ribs 362 and the end surface of the outer frame of the tank main body 32 such that a clearance is not formed. In this way, a plurality of small rooms is formed. Specifically, mainly, the air accommodating chamber 330, the liquid accommodating chamber 340, and the communication portion 350 are formed. That is, the air accommodating chamber 330, the liquid accommodating chamber 340, and the communication portion 350 are formed by the tank main body 32 and the first film 34. Since the first film 34 is a thin film form, the first film 34 is apt to be broken more than the hard tank main body 32. In addition, attachment of the first film 34 to the tank main body 32 is not limited to thermal welding and the attachment may be performed using, for example, an adhesive agent.

The second film 322 is attached to the tank main body 32 so as to cover the port opened to the air 318 or a portion of a serpentine flow path which includes the port opened to the air 318 and the air introduction port 317.

A plurality of projection portions 324 is formed at the tank main body 32 in the vicinity of the opening side face 370 so as to surround the outer periphery of the opening side face 370. Each projection portion 324 has a projection shape which extends from the tank main body 32 toward the outside. In this example, seven projection portions 324 are formed (in FIGS. 3 and 4, only three projection portions 324 are shown).

As shown in FIG. 4, the facing wall 372 has a wall 326 which is larger than the size of the opening OP, and an outer peripheral wall portion 325 which surrounds the outer periphery of the wall 326 and is provided by being erected from the outer periphery of the wall 326. In addition, the expression, "surrounding the outer periphery", means that it surrounds more than half of the outer periphery of the wall 326. The shape of the contour of the wall 326, the shape of the contour of the opening side face 370, and the shape of the contour of the opening OP are similar to each other and the outer periphery of the wall 326 is larger than the outer periphery of the opening side face 370 and the outer periphery of the opening OP.

The facing wall 372 is made such that a concave shape when viewing from the outside of the ink tank 30 is formed by the wall 326 and the outer peripheral wall portion 325. Specifically, the facing wall 372 has a concave shape when viewing from the side (the Y-axis negative direction side) opposite to the liquid accommodating chamber 340 across the facing wall 372. A plurality of hole portions 325*a* is formed in the outer peripheral wall portion 325. In this example, the number of hole portions 325*a* corresponds to the number of the projection portions 324. That is, seven hole portions 325*a* are formed in the outer peripheral wall portion 325. In a case where the tank unit 50 is formed by stacking a plurality of ink tanks 30, the projection portions 324 of one ink tank 30 are fitted into the hole portions 325*a* of the other adjacent ink tank 30, whereby the ink tanks 30 adjacent to each other are integrated. Since the tank main body 32 can be somewhat elastically deformed by an external force, two or more of the ink tanks 30 which are assembled and integrated can be disassembled by releasing fitting of the projection portions 324 into the hole portions 325*a*. Here, a fitting unit 328 (FIG. 4) is constituted by the projection portion 324 and the hole portion 325*a*.

Further, in a case where the tank unit 50 is formed, the first film 34 of any one of the ink tanks 30 enters a concave portion 327 of the facing wall 372 of the other adjacent ink tank 30. In other words, the outer periphery of the first film 34 of any one of the ink tanks 30 is surrounded by the outer peripheral wall portion 325. Here, the expression, "being surrounded", means that more than half of the outer periphery of the first film 34 is surrounded. Accordingly, a possibility that the first film 34 may be broken is reduced, so that a possibility that the ink in the liquid accommodating chamber 340 may be leaked to the outside can be reduced.

Figure 5:
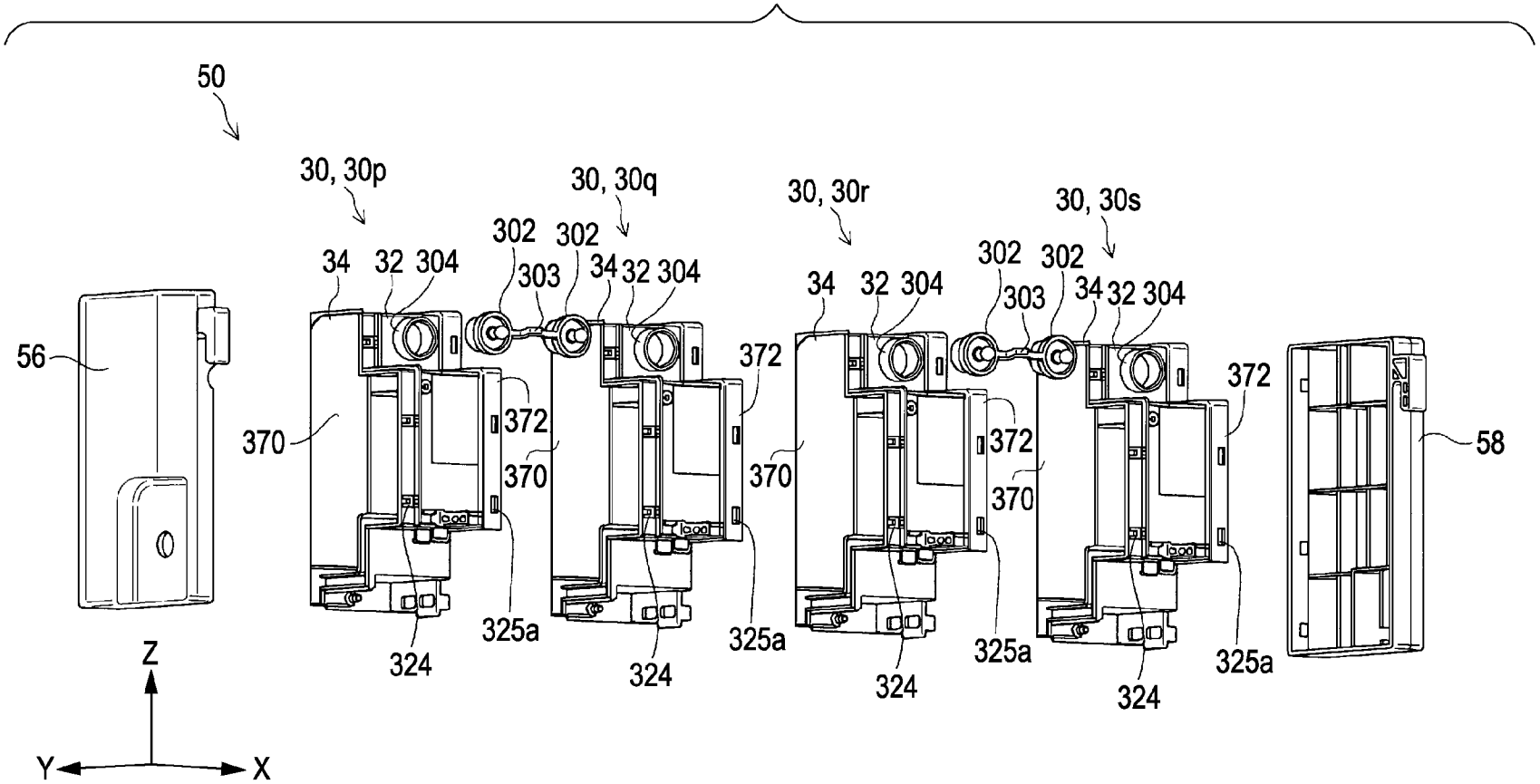
FIG. 5 is an exploded perspective view of a tank unit of the liquid ejecting system of FIGS. 1A and 1B.

FIG. 5 is an exploded perspective view of the tank unit 50. In addition, in FIG. 5, illustrations of the top case 54 and the bottom case are omitted. Further, with regard to the ink tank 30, in a case where the respective ink tanks 30 are used distinctively from each other, symbols 30*p*, 30*q*, 30*r*, and 30*s* are used.

A plurality of ink tanks 30 is disposed in a row. Specifically, a plurality of ink tanks 30 is disposed in a row in a direction (the Y-axis direction) in which the opening side face 370 and the facing wall 372 face each other. When a plurality of ink tanks 30 is disposed, the projection portions 324 of one ink tank 30 are fitted into the hole portions 325*a* of the other adjacent ink tank 30. Further, the ink tanks 30 are disposed such that the opening side face 370 side of one ink tank 30 enters the concave portion 327 of the facing wall 372 of the other adjacent ink tank 30, and the first film 34 of one ink tank 30 is protected by the facing wall 372 of the other ink tank 30.

The first film 34 of an ink tank 30*p* which is located at the end on one side of the ink tanks 30 disposed in a row is not covered by other ink tanks 30*q*, 30*r*, and 30*s*. Therefore, the opening side face 370 of the ink tank 30*p* is covered by the first side case 56. In this way, the first film 34 of the ink tank 30*p* is protected. Here, the ink tank 30*p* is equivalent to the "exposed liquid accommodating container" stated in the Summary.

Further, the plug member that blocks the liquid injection port 304 of one ink tank 30 and the plug member that blocks the liquid injection port 304 of the other adjacent ink tank 30 are connected to each other by a connection member 303. That is, the two plug members 302 are integrally constituted by the connection member 303 so as not to be able to be separated from each other. Even if the plug member 302 (also referred to as a "target plug member 302") is detached from the liquid injection port 304 when injecting (replenishing) ink into a certain ink tank 30, the target plug member 302 is connected to the plug member 302 (also referred to as an "adjacent plug member 302") of the other adjacent ink tank 30. Here, since the adjacent plug member 302 remains mounted on the liquid injection port 304 of the other ink tank 30, the target plug member 302 is located in the vicinity of the adjacent plug member 302. Accordingly, a possibility that a user may lose the detached plug member 302 can be reduced.

Figure 6:
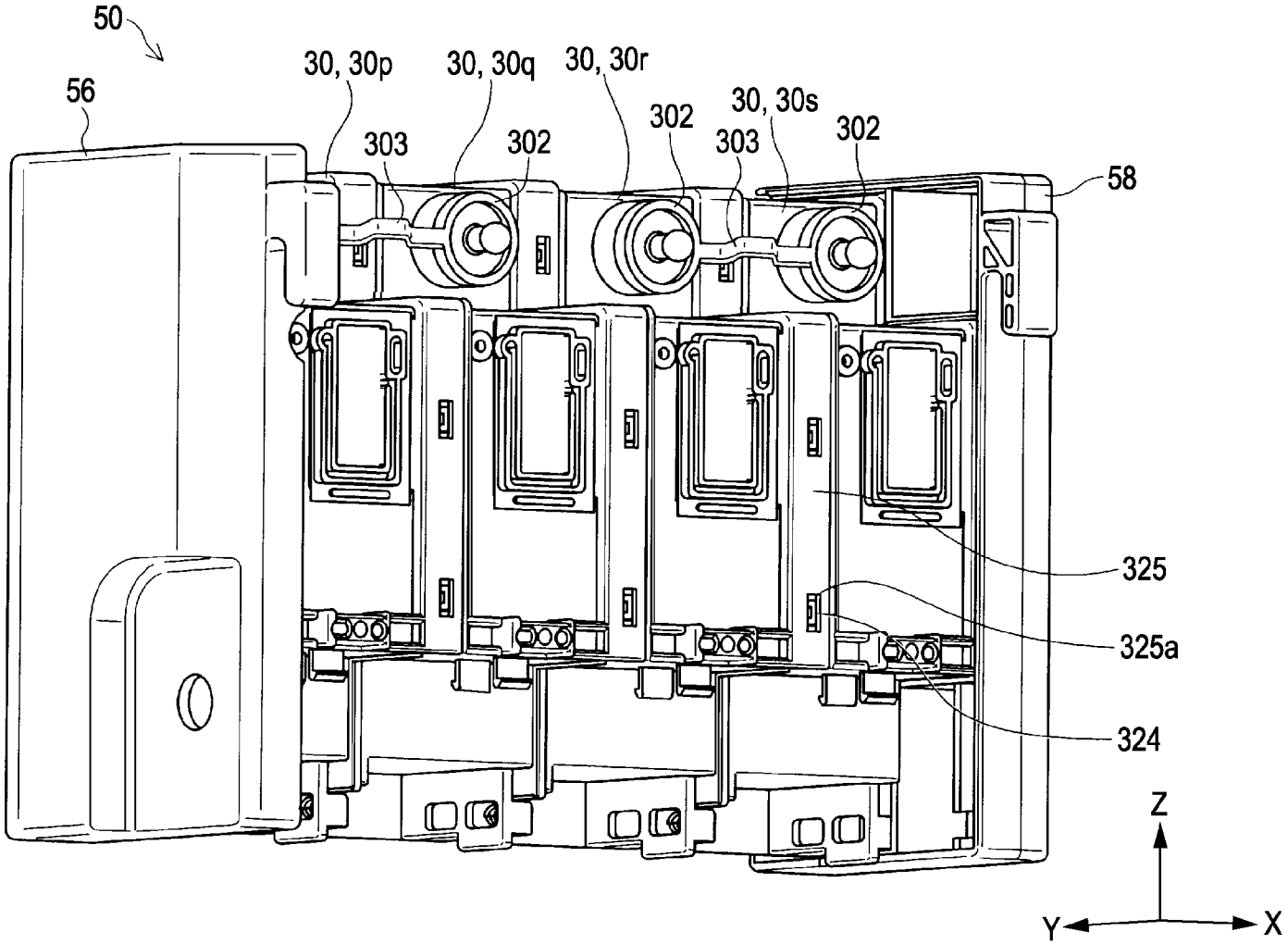
FIG. 6 is an exterior perspective view of the tank unit of FIG. 5.

FIG. 6 is an exterior perspective view of the tank unit 50. In addition, in FIG. 6, illustrations of the top case 54 and the bottom case are omitted. As shown in FIG. 6, the projection portions 324 of the other adjacent ink tank 30 is fitted into the hole portions 325*a* of one ink tank 30.

In this manner, in the above example, in each ink tank 30, an internal space such as the liquid accommodating chamber 340 is formed by attaching the first film 34 to one side face of the tank main body 32, one side face of which is opened. Accordingly, compared to a case where a hard cover member is vibration-welded to the tank main body 32, it is possible to easily form the internal space while securing air tightness of the inside of the ink tank 30. Further, a possibility that impurities such as shaving dregs of the tank main body 32 are mixed in the inside of the ink tank 30 can be reduced. Further, since the first film 34 is covered and protected by the tank main body 32 of an adjacent ink tank 30, a possibility that the first film 34 may be torn, causing leakage of ink from the inside, can be reduced. Further, compared to a case where hard members are vibration-welded to each other, thereby forming an ink tank, the size in a stacking direction (arrangement direction) of the ink tank can become compact. Accordingly, the tank unit 50 in which a plurality of ink tanks 30 is stacked can be reduced in size.

Further, two or more of the ink tanks 30 can be easily assembled and integrated by the projection portions 324 and the hole portions 325*a* and a possibility that the integrated ink tanks 30 may come apart can also be reduced. Further, two or more of the liquid accommodating containers which are integrated can be easily disassembled. Accordingly, the arrangement number of ink tanks 30 of the tank unit 50 can be easily changed in accordance with the number or the specification of ink colors which are used in the printer 12.

Additional Embodiments

In addition, elements other than the elements described in the independent claims among the constituent elements in the above example are additional elements and can be appropriately omitted. Further, the invention is not limited to the above-described example or embodiments and can be implemented in various forms within the scope that does not depart from the gist thereof, and for example, the following modifications are also possible.

In the above example, the facing wall 372 is provided with the outer peripheral wall portion 325 (FIG. 4). However, the outer peripheral wall portion 325 needs not to be provided. That is, in a first alternative embodiment the facing wall 372 has a shape capable of covering the surface of the first film 34 of an adjacent ink tank 30 in a case where two or more of the ink tanks 30 are disposed. Even in this way, similarly to the above example, the first film 34 of one ink tank 30 can be covered and protected by the facing wall 372 (specifically the wall 326) of the other adjacent ink tank 30.

In the above example, the ink tank 30 has the fitting unit 328 which includes the projection portion 324 and the hole portion 325*a*. However, in a second alternative embodiment the fitting unit 328 is omitted. Even in this way, similarly to the above example, the first film 34 of one ink tank 30 can be covered and protected by the facing wall 372 of the other adjacent ink tank 30.

In the above example, the ink tank 30 which is used in the printer 12 as a liquid accommodating container and the tank unit 50 have been described as an example. However, the invention is not limited thereto, but can be applied to a liquid accommodating container capable of supplying liquid from the outside of a liquid ejecting apparatus such as an apparatus provided with a head for ejecting a color material of, for example, a liquid crystal display or the like, an apparatus provided with an electrode material (conductive paste) ejecting head which is used for the electrode formation of an organic EL display, a surface-emitting display (FED), or the like, an apparatus provided with a biological organic matter ejecting head which is used for the manufacturing of biochips, an apparatus provided with a sample ejecting head as a precision pipette, a cloth printing apparatus, or a micro-dispenser, to the liquid ejecting apparatus, and a tank unit in which two or more of the liquid accommodating containers are disposed in a row. When using the liquid accommodating container in various liquid ejecting apparatuses described above, it is preferable if liquid (a color material, conductive paste, biological organic matter, or the like) according to the type of liquid that various liquid ejecting apparatuses eject is accommodated in the liquid accommodating container. Further, the invention can also be applied as a liquid ejecting system which includes each of various liquid ejecting apparatuses and a tank unit which is used in each of various liquid ejecting apparatuses.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tank unit for supplying liquid to a liquid ejecting apparatus, the tank unit comprising:

a plurality of liquid accommodating containers disposed in a row, each of the liquid accommodating containers including a main body having a concave shape defining a side opening and a film that blocks the side opening, the main body and the film at least partially defining a liquid accommodating chamber for accommodating a liquid, the main body including a facing wall that faces the film across the liquid accommodating chamber, the facing wall having a wall larger than the side opening, the wall including a wall portion disposed along the periphery thereof, the liquid accommodating containers being disposed such that the film of at least one of the liquid accommodating containers is covered by the facing wall of an adjacent one of the liquid accommodating containers and located within a space defined by the wall portion.

2. The tank unit of claim 1, wherein each of the liquid accommodating containers further includes at least one fitting portion on the wall portion, each of the fitting portions being configured for removable coupling to one of the fitting portions of an adjacent one of the liquid accommodating containers, each of the fitting portions including a projection portion and a hole portion into which the projection portion of the fitting portion of an adjacent one of the liquid accommodating containers is fitted.

3. The tank unit of claim 1, further comprising a cover member that covers the film of one of the liquid accommodating containers disposed at an end of the row.

4. The tank unit of claim 1, wherein each of the liquid accommodating containers includes:

a liquid injection port configured to have liquid injected therethrough into the liquid accommodating chamber; and a detachably mounted plug member configured to block the liquid injection port, at least one of the plug members is connected with a plug member of an adjacent one of the liquid accommodating containers by a connection member.

5. A tank unit for supplying liquid to a liquid ejecting apparatus, the tank unit comprising:

a plurality of liquid accommodating containers disposed in a row, each of the liquid accommodating containers including a liquid accommodating chamber, a liquid injection port configured to have liquid injected therethrough into the liquid accommodating chamber; and a detachably mounted plug member configured to block the liquid injection port of one of the liquid accommodating containers, connected with a plug member of an adjacent one of the liquid accommodating containers by a connection member.

6. A tank unit for supplying liquid to a liquid ejecting apparatus, the tank unit comprising:

a plurality of liquid accommodating containers disposed in a row, each of the liquid accommodating containers including a main body having a concave shape defining a side opening and a film that blocks the side opening, the main body and the film at least partially defining a liquid accommodating chamber for accommodating a liquid, the main body including a facing wall that faces the film across the liquid accommodating chamber, the facing wall having a wall larger than the side opening, the liquid accommodating containers being disposed such that the film of at least one of the liquid accommodating containers is covered by the facing wall of an adjacent one of the liquid accommodating containers.

7. The tank unit of claim 6, wherein each of the liquid accommodating containers further includes at least one fitting unit, each of the fitting units being configured for removable coupling to one of the fitting units of an adjacent one of the liquid accommodating containers, each of the fitting units including a projection portion and a hole portion into which the projection portion of a fitting unit of an adjacent one of the liquid accommodating containers is fitted.

8. A liquid ejecting system comprising:

the tank unit of claim 7;

a liquid ejecting apparatus that includes a head configured to eject liquid onto a target; and a flow tube that connects the tank unit and the liquid ejecting apparatus, the flow tube being configured to transfer liquid from the tank unit to the liquid ejecting apparatus.

9. The tank unit of claim 6, wherein each of the liquid accommodating containers includes:

a liquid injection port through which liquid can be injected into the liquid accommodating chamber, and a detachably mounted plug member configured to block the liquid injection port, at least one of the plug members is connected with a plug member of an adjacent one of the liquid accommodating containers by a connection member.

10. A liquid ejecting system comprising:

the tank unit of claim 9;

a liquid ejecting apparatus that includes a head configured to eject liquid onto a target; and a flow tube that connects the tank unit and the liquid ejecting apparatus, the flow tube being configured to transfer liquid from the tank unit to the liquid ejecting apparatus.

11. A liquid ejecting system comprising:

the tank unit of claim 6;

a liquid ejecting apparatus that includes a head configured to eject liquid onto a target; and a flow tube that connects the tank unit and the liquid ejecting apparatus, the flow tube being configured to transfer liquid from the tank unit to the liquid ejecting apparatus.

* * * * *